US011098454B2

(12) United States Patent
Constantine

(10) Patent No.: US 11,098,454 B2
(45) Date of Patent: Aug. 24, 2021

(54) TRACK RAIL FASTENER AND SYSTEM FOR PEDESTAL MOUNTED TRACK RAIL

(71) Applicant: Progress Rail Services Corporation, Albertville, AL (US)

(72) Inventor: Edward Constantine, Kansas City, MO (US)

(73) Assignee: Progress Rail Services Corporation, Albertville, AL (US)

( * ) Notice: Subject to any disclaimer, the term of this patent is extended or adjusted under 35 U.S.C. 154(b) by 324 days.

(21) Appl. No.: 16/371,429

(22) Filed: Apr. 1, 2019

(65) Prior Publication Data

US 2020/0308773 A1 Oct. 1, 2020

(51) Int. Cl.

| | |
|---|---|
| ***E01B 9/66*** | (2006.01) |
| ***E01B 9/68*** | (2006.01) |
| ***E01B 9/58*** | (2006.01) |

(52) U.S. Cl.

CPC ..... *E01B 9/66* (2013.01); *E01B 9/685* (2013.01); *E01B 9/58* (2013.01)

(58) Field of Classification Search

CPC ..... E01B 9/38; E01B 9/40; E01B 9/42; E01B 9/44; E01B 9/46; E01B 9/48; E01B 9/483; E01B 9/486; E01B 9/50; E01B 9/52; E01B 9/54; E01B 9/56; E01B 9/58; E01B 9/66; E01B 9/685; E01B 3/16

See application file for complete search history.

(56) References Cited

U.S. PATENT DOCUMENTS

| | | | | |
|---|---|---|---|---|
| 4,561,589 | A * | 12/1985 | Hixson | E01B 9/66 238/297 |
| 4,718,604 | A * | 1/1988 | Eisenberg | E01B 9/303 238/349 |
| 6,651,897 | B1 * | 11/2003 | Porrill | E01B 9/60 238/283 |
| 6,974,087 | B2 * | 12/2005 | Faichney | E01B 9/48 238/264 |
| 7,992,796 | B2 * | 8/2011 | Bednarczyk | E01B 9/40 238/264 |
| 8,602,317 | B2 * | 12/2013 | Bosterling | E01B 9/38 238/312 |

(Continued)

FOREIGN PATENT DOCUMENTS

| | | |
|---|---|---|
| CN | 202247547 U | 5/2012 |
| CN | 203065902 U | 7/2013 |

(Continued)

*Primary Examiner* — Jason C Smith

(74) *Attorney, Agent, or Firm* — Brannon Sowers & Cracraft

(57) ABSTRACT

A fastening system for track rail includes a track rail fastener positionable upon a pedestal mount, and including a top plate, a frame, and an overmolded jacket. The system further includes a lateral positioner having an eccentric structured to contact a pedestal mount, and a locating pin extending through the fastener body and the eccentric to couple a lateral location of the fastener body to an angular orientation of the eccentric, such that rotating the eccentric varies a lateral location of the fastener body. A frame in the fastener body includes a plurality of vertically extending finger walls for lateral and rotational stability, with the overmolded jacket extending between the finger walls and the top plate.

20 Claims, 4 Drawing Sheets

(56) References Cited

U.S. PATENT DOCUMENTS

| | | | | |
|---|---|---|---|---|
| 8,603,376 | B1 * | 12/2013 | Sands | E01B 26/00 264/31 |
| 8,740,106 | B2 * | 6/2014 | Ryou | E01B 9/303 238/338 |
| 8,833,671 | B2 * | 9/2014 | Cox | E01B 9/60 238/336 |
| 9,297,122 | B2 * | 3/2016 | Bosterling | E01B 9/30 |
| 10,081,915 | B2 | 9/2018 | Constantine | |
| 2002/0070283 | A1 * | 6/2002 | Young | E01B 9/38 238/264 |
| 2003/0084558 | A1 | 5/2003 | Rade | |
| 2006/0196962 | A1 * | 9/2006 | Osler | E01B 9/62 238/287 |
| 2007/0235551 | A1 * | 10/2007 | Ellerhorst | E01B 9/685 238/283 |
| 2008/0265050 | A1 * | 10/2008 | Osler | E01B 9/10 238/315 |
| 2011/0068184 | A1 * | 3/2011 | Rademacher | E01B 9/42 238/282 |
| 2012/0091216 | A1 * | 4/2012 | Osler | E01B 9/38 238/283 |
| 2014/0217192 | A1 * | 8/2014 | Constantine | E01B 9/02 238/297 |
| 2014/0231534 | A1 * | 8/2014 | Osler | E01B 9/62 238/287 |
| 2015/0060561 | A1 * | 3/2015 | Ciloglu | E01B 9/60 238/315 |
| 2016/0298298 | A1 * | 10/2016 | Constantine | E01B 9/42 |
| 2018/0023256 | A1 * | 1/2018 | Constantine | E01B 9/62 238/290 |
| 2018/0023257 | A1 * | 1/2018 | Constantine | E01B 9/483 238/304 |
| 2018/0363250 | A1 * | 12/2018 | Constantine | E01B 9/42 |
| 2020/0308773 | A1 * | 10/2020 | Constantine | E01B 9/42 |
| 2021/0047785 | A1 * | 2/2021 | Constantine | E01B 9/66 |

FOREIGN PATENT DOCUMENTS

| | | | |
|---|---|---|---|
| CN | 203755095 | U | 8/2014 |
| CN | 105297555 | A | 2/2016 |
| CN | 205046425 | U | 2/2016 |
| DE | 4233433 | | 4/1994 |
| EP | 1079023 | A2 | 2/2001 |
| GB | 2199062 | B | 6/1988 |
| KR | 20060103664 | A | 10/2006 |
| KR | 200459502 | Y1 | 3/2012 |
| KR | 20140109039 | A | 9/2014 |
| WO | 2012160238 | A1 | 11/2012 |
| WO | 2013053972 | A2 | 4/2013 |
| WO | 2016164154 | | 10/2016 |

* cited by examiner

TRACK RAIL FASTENER AND SYSTEM FOR PEDESTAL MOUNTED TRACK RAIL

TECHNICAL FIELD

The present disclosure relates generally to track rail fastening systems, and more particularly to direct fixation track rail fasteners.

BACKGROUND

Rail equipment is used across the world for transportation of persons and all manner of goods and equipment. Rail lines for freight or passenger, or for commuter trains, are formed by parallel track rails supported upon a concrete or gravel substrate, for example, and will be familiar to most. Depending upon the design of the rail line and the type of substrate, a variety of different mechanisms are used for positioning, supporting, and fastening the rails as well as managing loads and vibrations transmitted by way of the rail and fasteners between rail equipment and the underlying substrate. Rail fastening and fixation systems can range from simple plates that attach rails to wooden ties by way of spikes, to highly engineered direct fixation fasteners formed from an assembly of metallic and non-metallic components.

One known direct fixation fastener for track rail is known from U.S. Pat. No. 10,081,915 to Constantine. Constantine proposes a mechanism for coupling a track rail to a substrate including a rail plate and a base plate, where the rail plate surrounds the base plate and an overmolded jacket encases the both. The strategy taught in the Constantine disclosure has various applications, however, the field always welcomes improvements and/or alternative strategies.

SUMMARY OF THE INVENTION

In one aspect, a fastening system for track rail includes a pedestal mount having a pedestal plate, and a pair of laterally extending pedestal legs structured to support the pedestal plate above a substrate. The fastening system further includes a track rail fastener positioned upon the pedestal mount and including a fastener body having a top plate, a frame, an overmolded jacket encasing the top plate and the frame, and an upper rail contact surface extending in a fore-aft direction. The fastening system further includes a lateral positioner having a locating pin, and a positioner body with a locating surface extending circumferentially around a body axis, and a bore extending axially through the positioner body and eccentrically arranged with respect to the locating surface. The locating surface contacts the pedestal mount such that a lateral location of the body axis is fixed relative to the pedestal mount, and the locating pin extends through the fastener body and the bore such that a lateral location of the track rail fastener relative to the pedestal mount is coupled to a lateral location of the bore relative to the pedestal mount. The positioner body is at a first angular orientation about the body axis at which the bore has a first lateral location relative to the pedestal mount, and the positioner body is adjustable to a second angular orientation at which the bore has a second lateral location relative to the pedestal mount to reposition the track rail fastener based on the coupling of the lateral location of the track rail fastener to the lateral location of the bore.

In another aspect, a track rail fastener includes a fastener body having a top plate, a frame, an overmolded jacket encasing the top plate and the frame, and an upper rail contact surface extending in a fore-aft direction. The track rail fastener further includes a lateral positioner with a positioner body having a locating surface extending around a body axis, a bore extending axially through the positioner body, and a locating pin extending through the fastener body and the bore. The bore is eccentrically arranged with respect to the locating surface, and the positioner body is rotatable upon the locating pin, such that a change to an angular orientation of the bore about the body axis is coupled to a change to a lateral location of the fastener body relative to the body axis.

In still another aspect, a track rail fastener includes a fastener body having a top plate, a frame, an overmolded jacket, and an upper rail contact surface extending in a fore-aft direction. The track rail fastener further includes a lateral positioner with a positioner body having an eccentric structured to contact a pedestal mount and defining a body axis, and a locating pin structured to extend through the fastener body and the eccentric, to couple a lateral location of the fastener body relative to the body axis to an angular orientation of the eccentric about the locating pin. The frame includes a plurality of vertically extending finger walls, and the overmolded jacket encases the top plate and the frame and extends between the top plate and each of the plurality of vertically extending finger walls.

DETAILED DESCRIPTION

Figure 1:
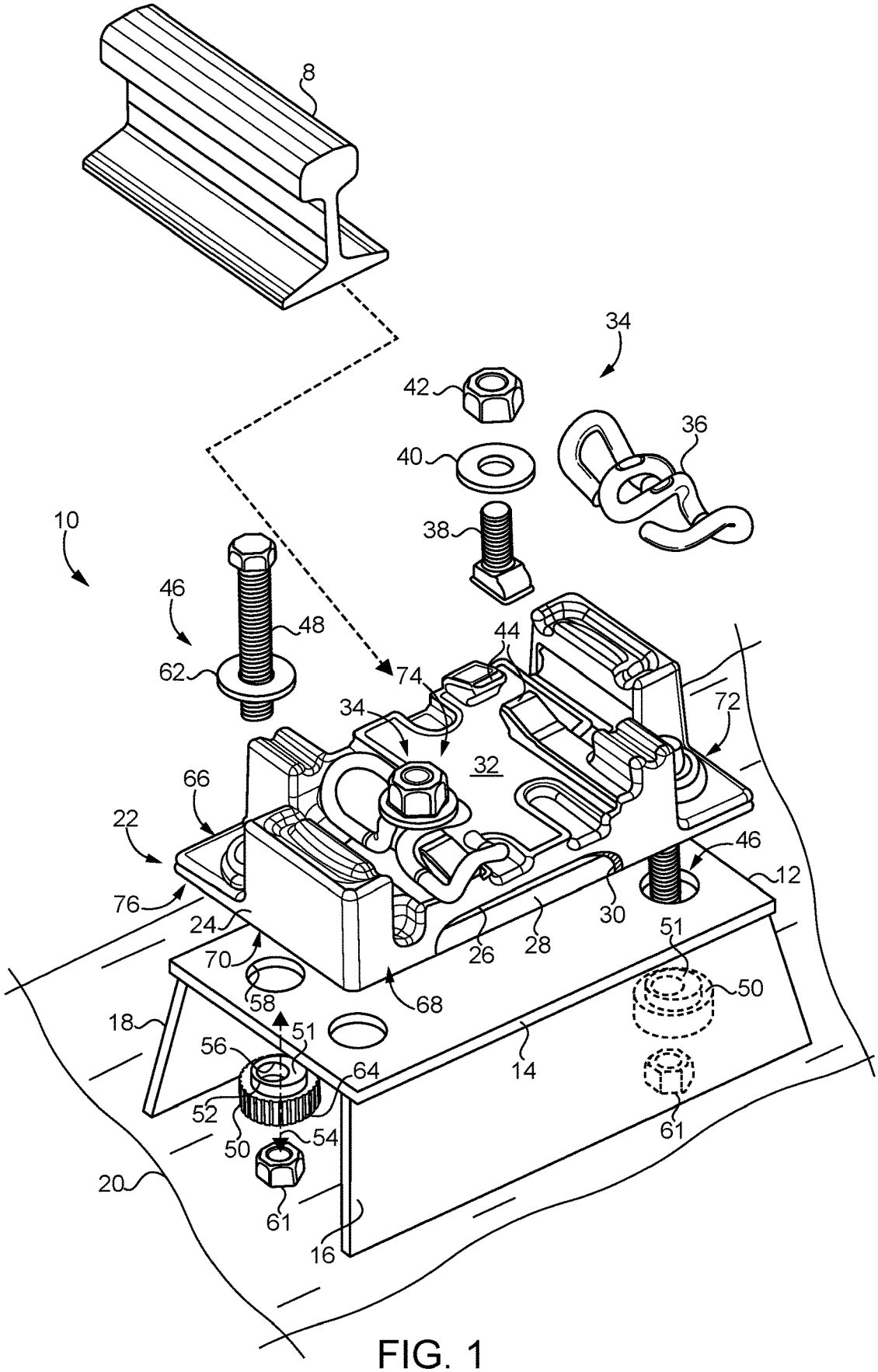
FIG. 1 is a disassembled view of a fastening system for track rail.

Referring to FIG. 1, there is shown a fastening system 10 for track rail according to one embodiment, and shown in proximity to a section of track rail 8 of conventional design. Fastening system 10 is a pedestal-style fastening system, including a pedestal mount 12 having a pedestal plate 14, and a pair of laterally extending pedestal legs 16 and 18 that depend downwardly from pedestal plate 14 and are structured to support pedestal plate 14 above a substrate 20. A pedestal-style fastening system might be used in connection with fastening track rail upon a rail bridge or the like, however, the present disclosure is not thereby limited. Pedestal legs 16 and 18 may be oriented widthwise to extend laterally across a longitudinal orientation of track rail 8, and can be attached to substrate 20 by any suitable strategy, such as by casting pedestal legs 16 and 18 in place within concrete of substrate 20, or bolting to substrate 20. Fastening system 10 also includes a track rail fastener 22 positioned upon pedestal mount 12 and including a fastener body 24. Fastener body 24 includes internal metallic components, such as cast, forged, or machined components including a top plate 26 and a frame 28. Track rail fastener 22 is shown in partial cutaway in FIG. 1 and illustrates diagrammatically top plate 26 positioned upon frame 28. An overmolded jacket 30 encases top plate 26 and frame 28. Overmolded jacket 30 can be formed of a non-metallic material, such as an elastomeric material, that is overmolded in a liquid form and cured so as to encase top plate 26 and frame 28 in a desired arrangement therein. Track rail fastener 22 also includes an upper rail contact surface 32 that is substantially planar to contact track rail 8 and transmit loads such as shocks and vibrations between track rail 8 and top plate 26, ultimately transmitting loads to frame 28, to pedestal mount 12, and to substrate 20. It can be desirable to provide some capability for lateral adjustment of a track rail fastener, for building new track, servicing existing track by way of replacement of track rail fasteners, or adjustment of the spacing separation between adjacent track rails in situ. Those skilled in the art will be familiar with material wear phenomena that track rails tend to experience, as well as other phenomena that can cause increasing or shortening of the spacing between parallel track rails. As will be further apparent from the following description, fastening system 10 is structured to provide for lateral adjustability of track rail fastener 22 relative to pedestal mount 12 in a simple and efficient manner.

Fastening system 10 and track rail fastener 22 further include a lateral positioner 46 including a locating pin 48, and a positioner body 50 having a locating surface 52 extending circumferentially around a body axis 54. Positioner body 50 also includes a bore 56 therein extending axially through positioner body 50 and eccentrically arranged with respect to locating surface 52. In the illustrated embodiment, locating surface 52 and bore 56 may be located on and in an eccentric 51 that is formed as a locator projection.

Fastener body 24 further includes a forward edge 66 and a back edge 68, which each extend generally in parallel with pedestal legs 16 and 18 when track rail fastener 22 is installed for service. A first outboard edge 70 and a second outboard edge 72 of fastener body 24 extend generally in parallel with a longitudinal orientation of track rail 8. Fastening system 10 also includes a first and a second rail clip assembly each shown with reference numeral 34, and positioned upon opposite lateral sides of rail support surface 32. Each clip assembly 34 can include a clip 36, a T-bolt 38, a washer 40, and a nut 42. Each T-bolt 38 can be slid between angled wedge blocks 44 formed integrally with top plate 26 in a generally known manner, or retained by any other suitable strategy.

Figure 2:
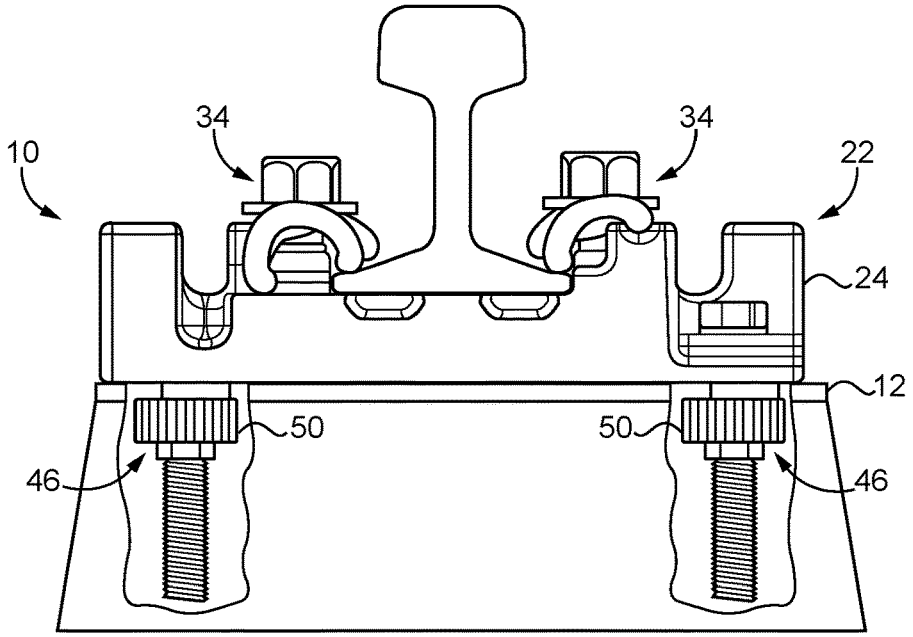
FIG. 2 is a partially open end view of the fastening system for track rail assembled for service.
Figure 3:
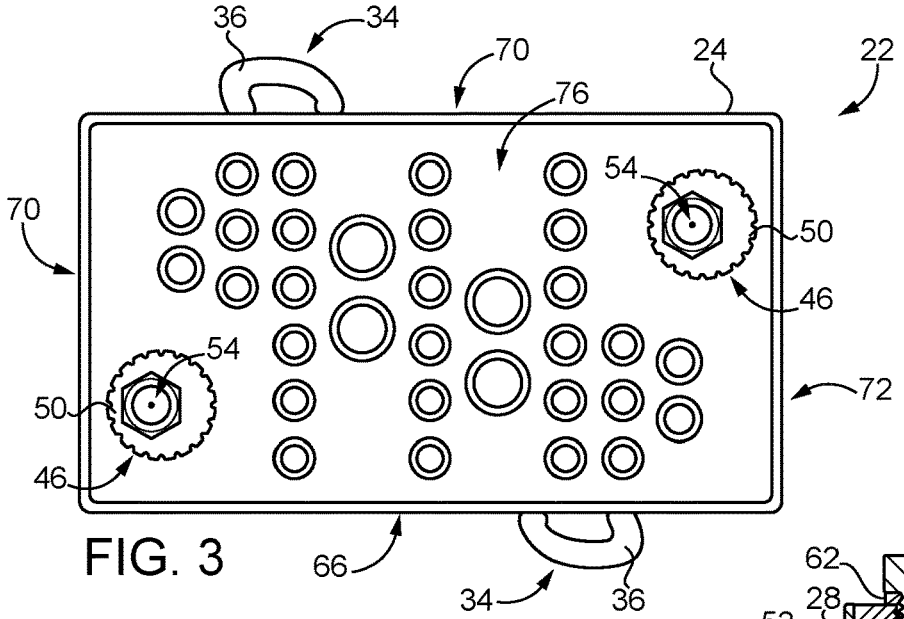
FIG. 3 is a bottom view of portions of the fastening system, according to one embodiment.
Figure 4:
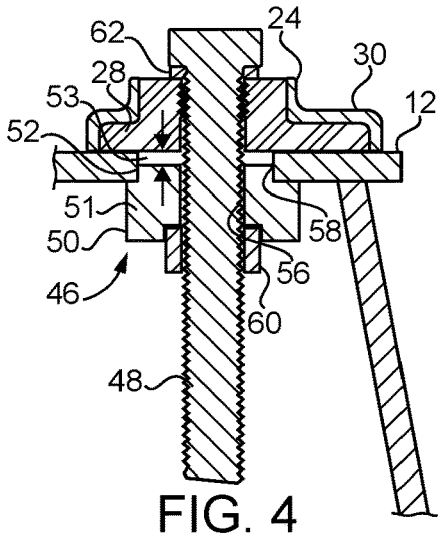
FIG. 4 is a sectioned view through a portion of the fastening system of FIGS. 1-3.

Referring also now to FIGS. 2-4, it can be seen that fastening system 10 can include a plurality of lateral positioners 46 each including a locating pin 48, a positioner body 50 having a locating surface 52 extending circumferentially around a body axis 54, and a bore 56 extending axially through positioner body 50, and eccentrically arranged with respect to locating surface 52. A first lateral positioner 46 and a second lateral positioner 46 may be substantially identical to one another, and locating pins 48 of the lateral positioners 46 may extend through opposite corners of frame 28 within fastener body 24. Discussion of lateral positioner 46 in the singular herein should be understood by way of analogy to refer to any additional lateral positioners of fastening system 10, which may be from one to four in number in most embodiments.

Locating surface 52, upon eccentric 51, contacts pedestal mount 12 such that a lateral location of body axis 54 is fixed relative to pedestal mount 12. Contact between locating surface 52 and pedestal mount 12 can include direct contact such as between locating surface 52 and pedestal plate 14 within a hole or bore 58 formed in pedestal plate 14, or indirect contact with a component mounted to pedestal plate 14 and thus a part of pedestal mount 12. In the illustrated embodiment, locating surface 52 includes an outer peripheral surface of positioner body 50. Bore 58 may extend vertically through pedestal plate 14, and locating surface 52 may have a shape complementary to bore 58, such as an annular cylindrical shape. It should nevertheless be appreciated that locating surface 52 could have a non-annular shape, such as a polygonal shape or a non-polygonal shape matched to a shape of bore 58, for example, and still fairly be understood to extend circumferentially around body axis 54. Body axis 54 may include a longitudinal center axis of positioner body 50, however, the present disclosure is also not limited in this regard. Body axis 54 will typically be located on a center point of a circle defined by locating surface 52. Based on the contact of locating surface 52 with pedestal plate 14, or otherwise contact with pedestal mount 12, positioner body 50 resists being laterally displaced when installed in pedestal plate 14. As shown in FIG. 4, an axial gap 53 extends between frame 28 and positioner body 50, allowing sufficient clearance for positioner body 50 to be tightened against pedestal plate 12 while clamping frame 28 flush against pedestal plate 12.

Locating pin 48 extends through fastener body 24 and through bore 56 such that a lateral location of track rail fastener 22 relative to pedestal mount 14 is coupled to a lateral location of bore 56 relative to pedestal mount 12. It will be recalled that bore 56 is eccentrically arranged with respect to locating surface 52. It will thus be understood that repositioning of positioner body 50, such as rotating positioner body 50 about body axis 54, will vary an angular orientation of bore 56 about body axis 54 and thus vary a lateral location of bore 56 relative to pedestal mount 12. In FIG. 1, it can be appreciated that locating pin 48, shown receiving a washer 62 such as a wedge lock washer, can be passed through fastener body 24, through bore 58 in pedestal plate 14, and through bore 56. With positioner body 52 positioned at a first angular orientation about body axis 54, bore 56 will have a first lateral location relative to pedestal mount 12. Adjusting positioner body 50 to a second angular orientation can position bore 56 at a second lateral location relative to pedestal mount 12 to reposition track rail fastener 22 based on the coupling of the lateral location of track rail fastener 22 to the lateral location of bore 56. It will also be appreciated that since bore 56 will effectively rotate about body axis 54, lateral adjustment of track rail fastener 22 can also vary a position of track rail fastener 22 in a fore-aft direction. The plurality of lateral positioners 46 can be adjusted together, such as by rotating positioner bodies 50 in the same direction, or separately, to shift track rail fastener 22 laterally as desired.

In the illustrated embodiment locating pin 48 is a threaded pin, that extends through frame 28 and through pedestal plate 14. Pedestal plate 14 is thus positioned between fastener body 24 and positioner body 50, such that positioner body 50 can be clamped to pedestal plate 14 at a first angular orientation, or any of a plurality of other available orientations corresponding to different relative lateral locations between track rail fastener 22 and body axis 54 and thus pedestal mount 12. Locating pin 48 can include a threaded bolt, with lateral positioner 46 also including a threaded nut 61 that is engaged with locating pin 48 to clamp positioner body 50 to pedestal plate 14 and also to clamp fastener body 24 to pedestal plate 14 on an upper side of pedestal plate 14 opposite to positioner body 50. In other embodiments, a positioner body and/or eccentric according to the present disclosure might be fitted within and engaged with a pedestal plate upon an upper side instead of a lower side as illustrated, with an associated fastener body formed with voids on a bottom side thereof to accommodate the positioner body/eccentric. When lateral adjustment is to be performed, nut 61 can be loosened or removed, and positioner body 50 dropped down, repositioned by rotating to a new angular orientation, and reinstalled. Alternatively, positioner body 50 could be left installed and locating pin 48 pulled clear of positioner body 50, and positioner body 50 rotated in place within pedestal plate 14. To assist in hand manipulation and placement of positioner body 50, positioner body 50 may have a non-uniform outer contour. The non-uniform outer contour may be formed by one or more flats, flutes, knurls, or some other texturing or geometry that facilitates service personnel gripping positioner body 50 more readily than a smooth and/or cylindrical outer surface would provide.

Figure 5:
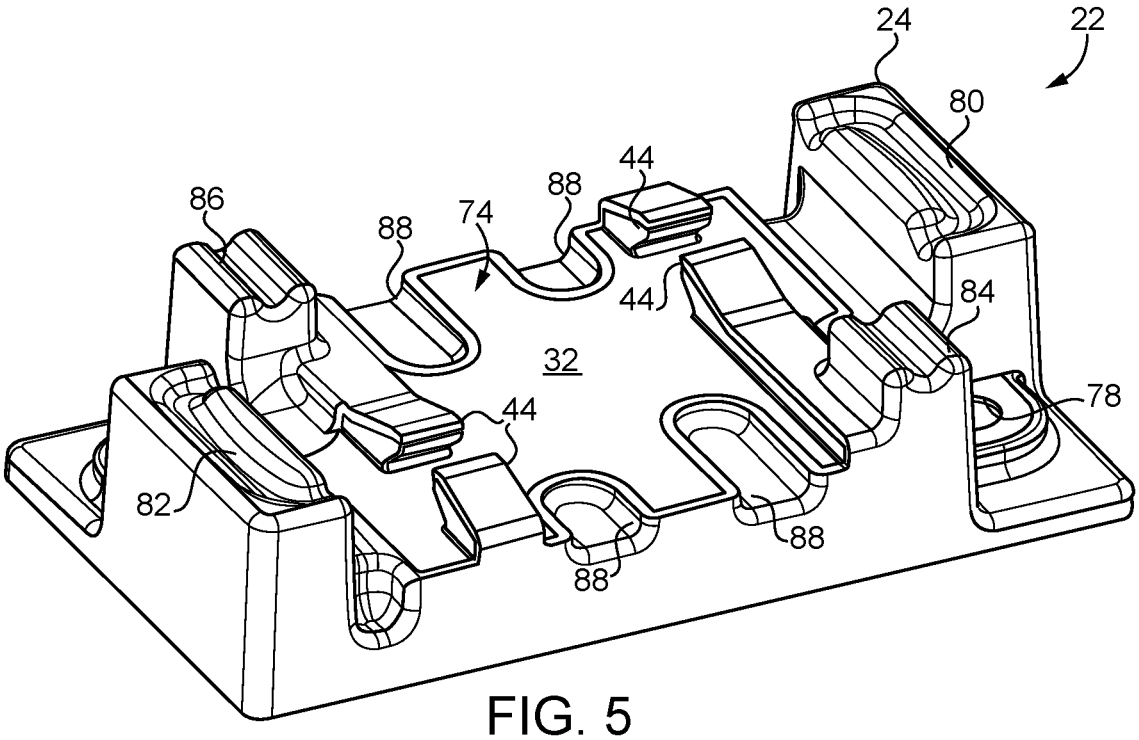
FIG. 5 is an isometric view of a track rail fastener body, according to one embodiment.
Figure 6:
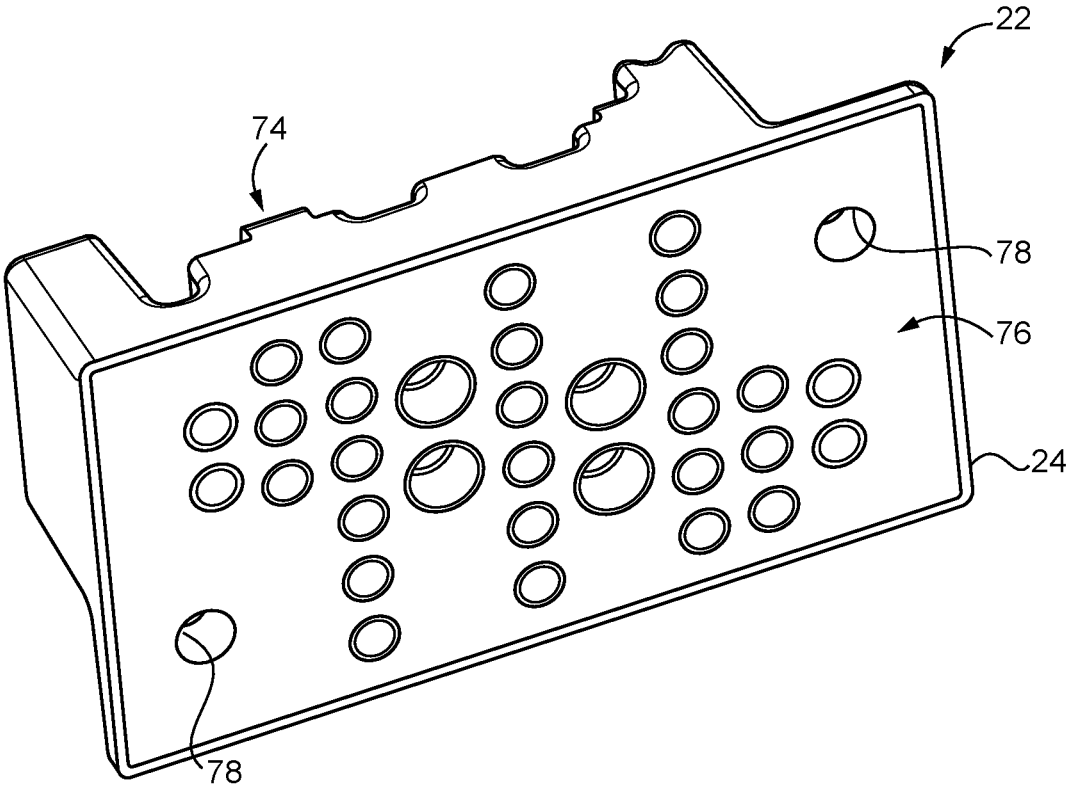
FIG. 6 is an isometric view of the fastener body, from a different viewpoint.

Referring also now to FIGS. 5 and 6, there is shown fastener body 24 with other pieces and parts of fastening system 10 removed. Fastener body 24 may have a plurality of holes 78 formed therein at opposite corners of fastener body 24 and within frame 28 that receive locating pins 48 therethrough. Upper rail contact surface 32 may be formed by exposed (not encased by jacket 60) material of top plate 26. Fastener body 24 includes a plurality of vertically protruding structures 80, 82, 84, and 86. Vertically protruding structures 80, 82, 84, and 86 are formed by overmolded jacket 60, with parts of frame 28 and top plate 26 providing an internal skeleton, as will be further described below. Fastener body 24 also includes vertical cutouts 88 formed in or adjacent to upper rail support surface 32. Lower side 76 may be formed by exposed material of frame 28 not encased by jacket 60.

Figure 7:
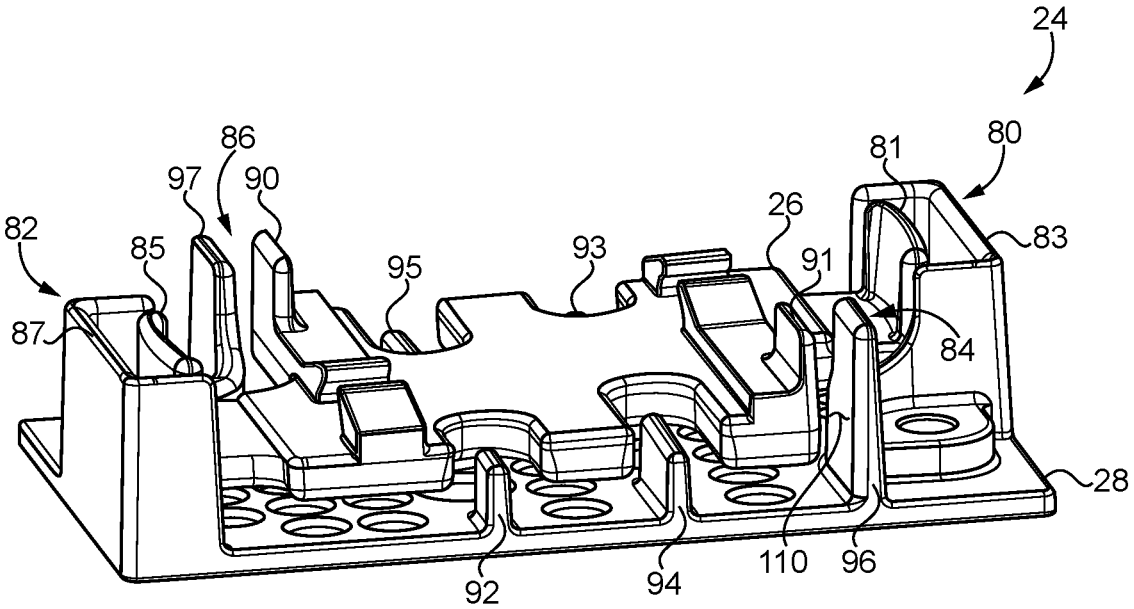
FIG. 7 is a diagrammatic view of a frame and top plate for a track rail fastener, according to one embodiment.
Figure 8:
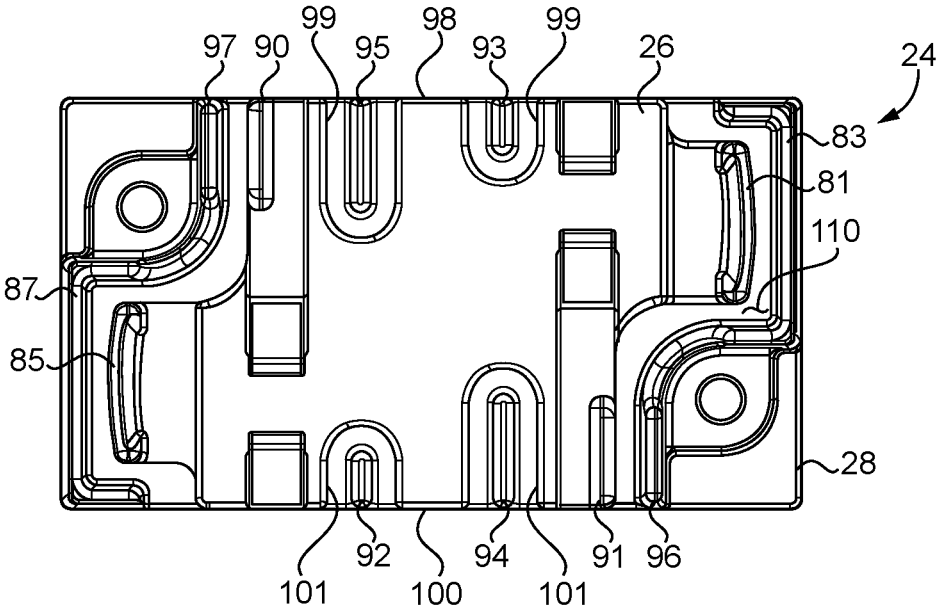
FIG. 8 is a top view of the frame and top plate of FIG. 7.

Referring also now to FIGS. 7 and 8, there is shown fastener body 24 as it might appear with jacket 60 removed. Top plate 26 is positioned upon frame 28, and a peripheral gap 110 extends between top plate 26 and frame 28. Material of overmolded jacket 60 will fill peripheral gap 110. Holes (not numbered) are also formed in frame 28 that can assist in flow of material to form overmolded jacket 60 prior to curing, assisting in jacket 60 making its way between and among the features of top plate 26 and frame 28. Also shown in FIGS. 7 and 8 are an end wall 81 of top plate 26 positioned adjacent to another end wall 83 of frame 28. Material of overmolded jacket 60 will fill peripheral gap 110 between end wall 81 and end wall 83, and between a pair of opposite end walls 85 and 87, to form protruding structures 80 and 82. In service, the resilient material of overmolded jacket 60 can transmit loads between the respective end walls 81, 83 and 85, 87 to, among other things, assist in lateral and rotational stability and load management in track rail fastener 22. End walls 83 and 87 may have C-shapes, generally, with end walls 81 and 85 received, respectively, within the "C's." Between the respective end walls, material of jacket 60 may fill in peripheral gap 110 and extend vertically between a bottom of peripheral gap 110 and, up and over tops of end walls 81, 83, 85, 87. Each of end walls 81 and 85 may be curved in the fore-aft direction as shown in FIGS. 7 and 8.

Frame 28 also includes a plurality of vertically extending finger walls 92, 93, 94, 95, 96, 97. Vertically extending finger walls 92-96 have non-uniform heights in the illustrated embodiment and are arranged in a forward set 93, 95, 97 and a back set 92, 94, 96. In an implementation, the forward set of vertically extending finger walls 93, 95, 97 have heights successively increased in a first lateral direction, to the left in FIGS. 7 and 8, whereas the back set of vertically extending finger walls 92, 94, 96 have heights successively increased in a second lateral direction, to the right in FIGS. 7 and 8. Vertically extending-finger walls 96 and 97 are adjacent, respectively, to vertically extending mid-walls 91 and 90 of top plate 26, and which can together be encased with material of jacket 60 to form protruding structures 84 and 86. A running length of finger walls 94 and 95 may be greater than a running length of finger walls 92 and 93. Top plate 26 further has a forward or front peripheral edge 98 and a back peripheral edge 100. Vertically extending finger walls 92-95 are each received at least partially within one of a plurality of peripheral cutouts including a front or forward set of peripheral cutouts 99 and a back set of peripheral cutouts 100. It will also be noted that the tallest vertically extending finger walls 96 and 97 are not within peripheral cutouts, and are connected by way of reduced height transitioning walls (not numbered) with end walls 83 and 87, respectively.

INDUSTRIAL APPLICABILITY

As discussed above, fastening system 10 can be deployed as part of new construction, or in servicing existing track. Over the course of a service life of rail track, wear from rotating stock as well as deformation or displacement of track rail and fastening systems themselves can cause a lateral distance between inside rail surfaces to vary from specifications. In certain applications, such as pedestal mounts, the ability to provide lateral adjustment has heretofore not existed or been unduly labor intensive.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

LIST OF ELEMENTS

8 rail
10 fastening system
12 pedestal mount
14 pedestal plate
16 pedestal leg
18 pedestal leg
20 substrate
22 track rail fastener
24 fastener body
26 top plate
28 frame
30 jacket
32 rail contact surface
34 clip assembly
36 clip
38 T-bolt
40 washer
42 nut

44 wedge block
46 lateral positioner
48 locating pin
50 positioner body
51 eccentric
52 locating surface
53 axial gap
54 body axis
55 gap clearance
56 bore
58 hole
60 over molded coating
61 nut
62 wedge lock washer
64 flutes
66 forward edge
68 back edge
70 first outboard edge
72 second outboard edge
74 upper side
76 lower side
78 hole
80 protrusion
81 end wall
82 protrusion
83 end wall
84 protrusion
85 end wall
86 protrusion
87 end wall
88 cutouts
90 vertical wall
91 vertical wall
92 finger wall
93 finger wall
94 finger wall
95 finger wall
96 finger wall
97 finger wall
98 forward edge
99 peripheral cutout
100 back edge
101 peripheral cutout

What is claimed is:

1. A fastening system for track rail comprising:

a pedestal mount including a pedestal plate, and a pair of laterally extending pedestal legs structured to support the pedestal plate above a substrate;

a track rail fastener positioned upon the pedestal mount and including a fastener body having a top plate, a frame, an overmolded jacket encasing the top plate and the frame, and an upper rail contact surface extending in a fore-aft direction;

a lateral positioner including a locating pin, and a positioner body including a locating surface extending circumferentially around a body axis, and a bore extending axially through the positioner body and eccentrically arranged with respect to the locating surface;

the locating surface contacting the pedestal mount such that a lateral location of the body axis is fixed relative to the pedestal mount;

the locating pin extending through the fastener body and the bore such that a lateral location of the track rail fastener relative to the pedestal mount is coupled to a lateral location of the bore relative to the pedestal mount; and the positioner body is at a first angular orientation about the body axis at which the bore has a first lateral location relative to the pedestal mount, and is adjustable to a second angular orientation at which the bore has a second lateral location relative to the pedestal mount to reposition the track rail fastener based on the coupling of the lateral location of the track rail fastener to the lateral location of the bore.

2. The fastening system of claim 1 wherein the locating pin is a threaded pin extending through the frame and the pedestal plate.

3. The fastening system of claim 2 wherein:

the pedestal plate is positioned between the fastener body and the positioner body and the positioner body is clamped to the pedestal plate at the first angular orientation; and an axial gap extends between the positioner body and the frame.

4. The fastening system of claim 1 wherein the locating surface includes an outer peripheral surface of the positioner body.

5. The fastening system of claim 4 wherein the pedestal plate has a bore formed therein, and the locating surface is in contact with the pedestal plate within the bore.

6. The fastening system of claim 1 further comprising a second lateral positioner substantially identical to the first lateral positioner, and the locating pins of the first lateral positioner and the second lateral positioner extend through opposite corners of the frame within the fastener body.

7. The fastening system of claim 1 wherein a peripheral gap extends between the top plate and the frame and material of the overmolded jacket fills the peripheral gap.

8. The fastening system of claim 1 wherein:

the top plate includes a plurality of peripheral cutouts;

the frame includes a plurality of vertically extending finger walls positioned within the plurality of peripheral cutouts; and material of the overmolded jacket extends between each of the plurality of peripheral cutouts and the plurality of vertically extending finger walls.

9. A track rail fastener comprising:

a fastener body having a top plate, a frame, an overmolded jacket encasing the top plate and the frame, and an upper rail contact surface extending in a fore-aft direction;

a lateral positioner including a positioner body having a locating surface extending around a body axis, a bore extending axially through the positioner body, and a locating pin extending through the fastener body and the bore; and the bore being eccentrically arranged with respect to the locating surface, and the positioner body being rotatable upon the locating pin, such that a change to an angular orientation of the bore about the body axis is coupled to a change to a lateral location of the fastener body relative to the body axis.

10. The track rail fastener of claim 9 wherein the locating surface includes an outer peripheral surface formed on a locator projection of the positioner body.

11. The track rail fastener of claim 10 wherein the positioner body includes a non-uniform outer contour.

12. The track rail fastener of claim 11 wherein the non-uniform outer contour is formed by flats, flutes, or knurls.

13. The track rail fastener of claim 9 wherein the locating pin includes a threaded pin, and wherein the track rail fastener includes a nut threaded engaged with the locating pin and trapping the positioner body between the fastener body and the nut.

14. The track rail fastener of claim 9 further comprising a second lateral positioner substantially identical to the first lateral positioner, and the locating pins of the first lateral positioner and the second lateral positioner extend through opposite corners of the frame in the fastener body.

15. The track rail fastener of claim 9 further comprising a first rail clip assembly and a second rail clip assembly positioned upon opposite lateral sides of the upper rail contact surface.

16. The track rail fastener of claim 9 wherein the frame includes a plurality of vertically extending finger walls, and material of the overmolded jacket extends between the top plate and each of the plurality of vertically extending finger walls.

17. The track rail fastener of claim 16 wherein the plurality of vertically extending finger walls includes a forward set of vertically extending finger walls having non-uniform heights, and a back set of vertically extending finger walls having non-uniform heights.

18. The track rail fastener of claim 17 wherein the forward set of vertically extending finger walls have heights successively increased in a first lateral direction, and the back set of vertically extending finger walls have heights successively increased in a second lateral direction.

19. The track rail fastener of claim 18 wherein the top plate has a plurality of peripheral cutouts formed therein, and each of the plurality of vertically extending finger walls is received at least partially within one of the plurality of peripheral cutouts.

20. A track rail fastener comprising:

a fastener body having a top plate, a frame, an overmolded jacket, and an upper rail contact surface extending in a fore-aft direction;

a lateral positioner including a positioner body having an eccentric structured to contact a pedestal mount and defining a body axis, and a locating pin structured to extend through the fastener body and the eccentric, to couple a lateral location of the fastener body relative to the body axis to an angular orientation of the eccentric about the locating pin;

the frame including a plurality of vertically extending finger walls; and the overmolded jacket encasing the top plate and the frame and extending between the top plate and each of the plurality of vertically extending finger walls.

* * * * *